United States Patent [19]

Clark

[11] Patent Number: 4,714,859

[45] Date of Patent: Dec. 22, 1987

[54] MAGNETRONS

[75] Inventor: Michael J. Clark, Watford, England

[73] Assignee: The M-O Valve Company Limited, England

[21] Appl. No.: 842,318

[22] Filed: Mar. 21, 1986

[30] Foreign Application Priority Data

Mar. 25, 1985 [GB] United Kingdom ..... 8507721

[51] Int. Cl.[4] ..... H01J 23/22

[52] U.S. Cl. ..... 315/39.67; 315/39.51; 315/39.75

[58] Field of Search ..... 315/39.51, 39.69, 39.75

[56] References Cited

U.S. PATENT DOCUMENTS

| | | | |
|---|---|---|---|
| 2,810,094 | 10/1957 | Derby et al. | 315/39.51 |
| 2,852,720 | 9/1958 | Crapuchettes | 315/39.75 |
| 3,289,037 | 11/1966 | Whitmore | 315/39.69 |
| 3,553,524 | 1/1971 | Hill | 315/39.69 |
| 4,063,129 | 12/1977 | Miura et al. | 315/39.69 |
| 4,287,451 | 9/1981 | Koinuma et al. | 315/39.69 |
| 4,485,330 | 11/1984 | Tsuzurahara et al. | 315/39.75 |

*Primary Examiner*—Saxfield Chatmon

*Attorney, Agent, or Firm*—Kirschstein, Kirschstein, Ottinger & Israel

[57] ABSTRACT

The invention concerns a resonant cavity magnetron employing a strapped vane anode (4, 9, 11, 13, 15) structure. In order to compensate for thermal variations at least one of the straps (13) is made from a material or materials having a different temperature coefficient of linear expansion to the vanes (4) such that the strap (13) will deform with temperature variation in a predictable manner to modify the resonant frequency of the magnetron.

7 Claims, 2 Drawing Figures

MAGNETRONS

BACKGROUND OF THE INVENTION

1. Field of the Invention

This invention relates to magnetrons. In particular the invention relates to resonant cavity magnetrons employing a strapped vane anode structure.

2. Description of Related Art

A magnetron of this kind is disclosed in U.S. Pat. No. 4,287,451. This magnetron is shown as having iron or copper strap rings which are used to strap copper vanes. The combinations of materials in the vanes and straps of this specification have been chosen to prevent vane cracking in the event of the expansion of the vanes and strap rings with temperature.

Such magnetrons comprise a cylindrical anode having a plurality of inwardly extending radial vanes which together form multi-resonating cavities. A cathode extends along the axis of the anode forming an interaction space between free edges of the vanes and the cathode. When in use an electric field is generated between the anode and the cathode and a magnetic field along the axis of the andoe. Microwave energy is induced in the cavities between the anode vanes.

The temperature coefficient of frequency of such a magnetron is approximately equal to the temperature coefficient of linear expansion of the anode materials of the magnetron if endspace effects are discounted. This can cause problems whenever magnetrons of this type are to be used in conditions where the ambient temperature can fluctuate. Some reduction in the temperature coefficient of frequency may therefore be achieved by manufacturing the anode from a material having a low coefficient of linear expansion, for example molybdenum. In order to maintain a high figure of merit, $Q_o$ for the magnetron, the microwave conducting surfaces of the anode have to be copper clad, however.

SUMMARY OF THE INVENTION

It is an object of the present invention to provide a resonant cavity magnetron employing a strapped vane structure anode including an alternative means of controlling the temperature coefficient of frequency.

According to the present invention a resonant cavity magnetron employing a strapped vane anode structure is characterised in that at least one of the straps is of a material having a different temperature coefficient of linear expansion to the vanes which it straps, such that the strap will deform with temperature variation in a predictable manner thereby to modify the resonant frequency of the magnetron.

The invention thus resides in the appreciation by the inventor that by causing at least one of the straps to deform as a result of change in temperature, thus altering the strap to vane and the inter-strap capacitance, the resulting change in resonant frequency can be made to vary considerably from the change which might otherwise result from thermal expansion of the vane structure and/or the other parts of the anode defining the resonant cavities.

BRIEF DESCRIPTION OF THE DRAWINGS

One particular resonant cavity magnetron, in accordance with the invention, will now be described, by way of example only, with reference to the accompanying drawings in which.

DETAILED DESCRIPTION OF THE PREFERRED EMBODIMENTS

Figure 1:
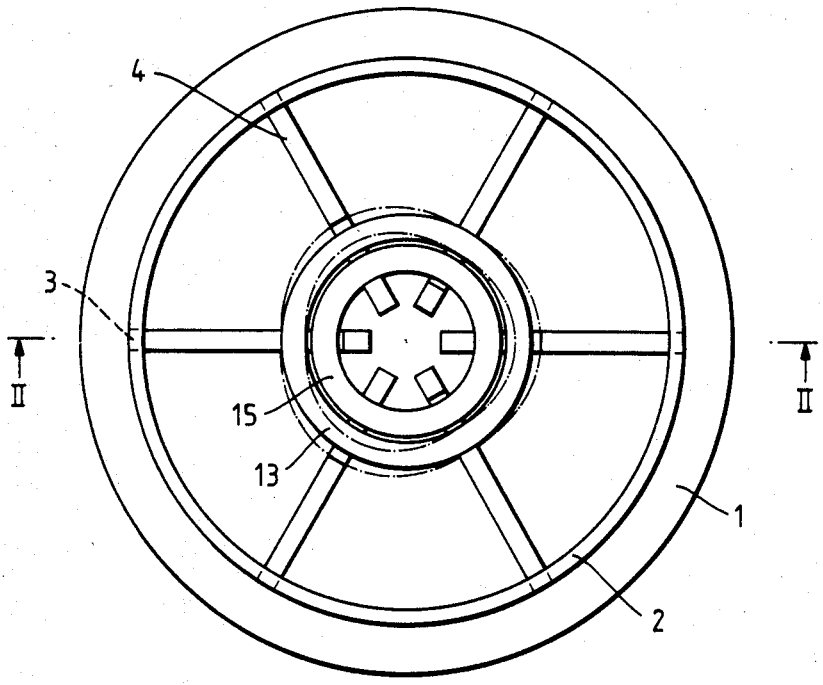
FIG. 1 is a plan view of the anode structure of the magnetron.

Referring to the figures, the magnetron employs an anode structure comprising a tubular molybdenum outer wall 1, containing a copper tube 2 in which are formed six slots 3 from which extend inwardly six equally spaced, radial vanes 4 formed of copper-clad molybdenum. The structure thus comprises a re-entrant periodic structure of six coupled resonant cavities defined by the vanes 4 and the tube 2. The magnetron also includes a magnet (not shown) for providing the magnetic field required during operation of the magnetron, a cathode (also not shown) located in the space between the inner ends of the vanes 4, and a microwave output waveguide (also not shown).

The vanes 4 are provided with two pairs 9, 11 and 13, 15, of co-axial circular straps, one pair 9, 11 of which are located at the lower end of the vanes 4, the other pair 13, 15 being located at the upper end of the vanes. The straps 11, 13 are connected by brazing to one set of alternate vanes 4, whilst the straps 9, 15 are connected by brazing to the other pair of alternate vanes: slots 17 are provided in the vanes 4 where a strap 9, 11, 13 or 15 is required to pass without making electrical connection. The two lower straps 9, 11 and the innermost upper strap 15 are all formed of molybdenum, whilst the remaining strap 13 is formed of copper.

In operation of the magnetron, any increase in temperature will cause the copper strap 13 to deform outwards between its brazed connections to the vanes 4 away from its paired inner strap 15, towards the dotted configuration shown in FIG. 1. By appropriate design of the anode structure, the consequent reduction in interstrap capacitance and strap to vane capacitance can be arranged to nearly exactly compensate for the frequency deviation which would otherwise occur as a result of the thermal expansion of the molybdenum vanes 4 and tube 2.

It will be appreciated that whilst in the resonant cavity magnetron described herebefore by way of example, only one strap, an outer strap, is of a different material to the vane which it straps, the invention is equally applicable to magnetrons in which more than one strap is of a different material or materials, or which employ different total numbers of straps.

Figure 2:
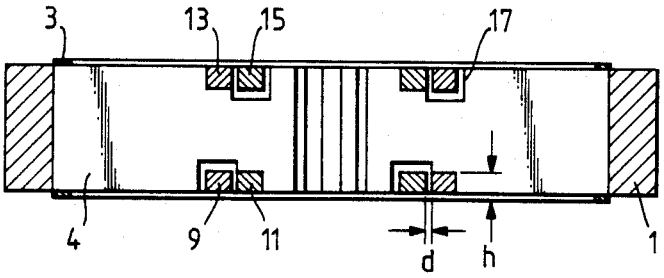
FIG. 2 is a sectional view on the line II—II of FIG. 1.

With regard to fabricating the anode structure so that the inter-strap capacitance and the strap-to-vane capacitance vary in the requisite manner the following procedure should be carried out. Considering a six-vane magnetron of the kind shown in the drawings the resonators are designed to give the correct $\pi$-mode frequency and $\pi$ to $\pi-1$ mode separation by a combination of cavity lengths and theoretical value of capacitance by strapping. The vane structure being of low thermal expansion the deformation of a single strap of different metal and hence the expansion coefficient is determined theoretically at a known radius. This deformation is then employed to determine the necessary strap-strap separation to give the correct capacitance variations to stabilize frequency against normal temperature coefficients. This separation is shown at d in FIG. 2. Having thereby determined strap radius and separation, the strap height h, again shown in FIG. 2, is then calculated to provide the correct total capacitance value.

I claim:

1. A resonant cavity magnetron, comprising:

(a) a cylindrical anode having an axis and a plurality of inwardly extending radial vanes which together define multi-resonating cavities, said vanes having free edges;

(b) a cathode extending along the axis of said anode to define an interaction space between the free edges of said vanes and said cathode; and (c) at least two coaxial straps of differing materials, said straps being connected to alternate different ones of said vanes and passing freely the vanes to which they are not connected, at least one of said straps having a greater coefficient of linear expansion than the vanes which it straps such that, on an increase in operating temperature, the straps with the greater coefficient of linear expansion will deform outwardly between its connections to its associated vanes to reduce the inter-strap and strap-to-vane capacitance in such a manner as to compensate for the frequency variation which would otherwise have been caused by the temperature rises.

2. A magnetron as claimed in claim 1, and comprising four coaxial straps arranged in two pairs, one pair being located at the upper ends and the other at the lower ends of the vanes, one strap of each pair being connected to one set of alternate vanes, and the other straps being connected to the remaining vanes.

3. A magnetron as claimed in claim 2, wherein one strap of the two pairs has a higher coefficient of thermal expansion than the three other straps.

4. A magnetron as claimed in claim 3, wherein the strap with the higher coefficient is the outer strap of its pair.

5. A magnetron as claimed in claim 4, wherein the higher coefficient strap is of copper and the other strap or straps of molybdenum.

6. A magnetron as claimed in claim 1, and characterised in that the connections between the straps and the vanes are brazed connections.

7. A magnetron as claimed in claim 1 wherein the vanes are copper-clad molybdenum.

* * * * *